US005584486A

United States Patent [19]

Franklin

[11] Patent Number: 5,584,486

[45] Date of Patent: Dec. 17, 1996

[54] JACKPOT PAI GOW POKER

[76] Inventor: Thomas L. Franklin, 810 Ford St., Gulfport, Miss. 39507

[21] Appl. No.: 580,283

[22] Filed: Dec. 27, 1995

[51] Int. Cl.[6] ..... A63F 1/00

[52] U.S. Cl. ..... 273/292; 273/274

[58] Field of Search ..... 273/292, 274, 273/309

[56] References Cited

U.S. PATENT DOCUMENTS

| | | | |
|---|---|---|---|
| 4,861,041 | 8/1989 | Jones et al. | 273/292 |
| 5,098,107 | 3/1992 | Boylan et al. | 273/292 |

OTHER PUBLICATIONS

"Pai Gow Poker Tommy's Way" by Thomas L. Franklin, 30–page booklet, circa 1989.

"Pai Gow Poker", Win Magazine, Linya Quan, pp. 39, 40 and 70 Apr. 1992.

*Primary Examiner*—Benjamin H. Layno

*Attorney, Agent, or Firm*—Quirk & Tratos

[57] ABSTRACT

An improved game of Pai Gow Poker is disclosed in which a player is permitted to make a jackpot wager along with the first bet, with the player winning the jackpot wager when he is dealt a predetermined seven card jackpot holding.

4 Claims, 1 Drawing Sheet

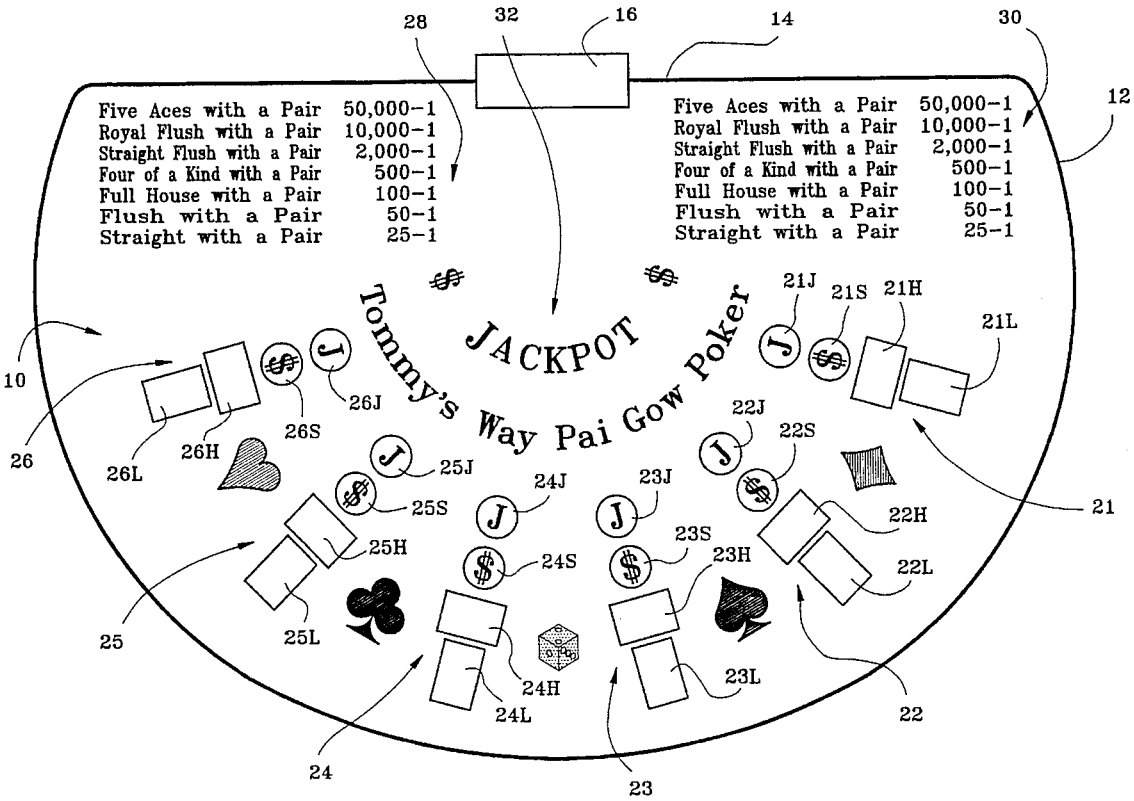

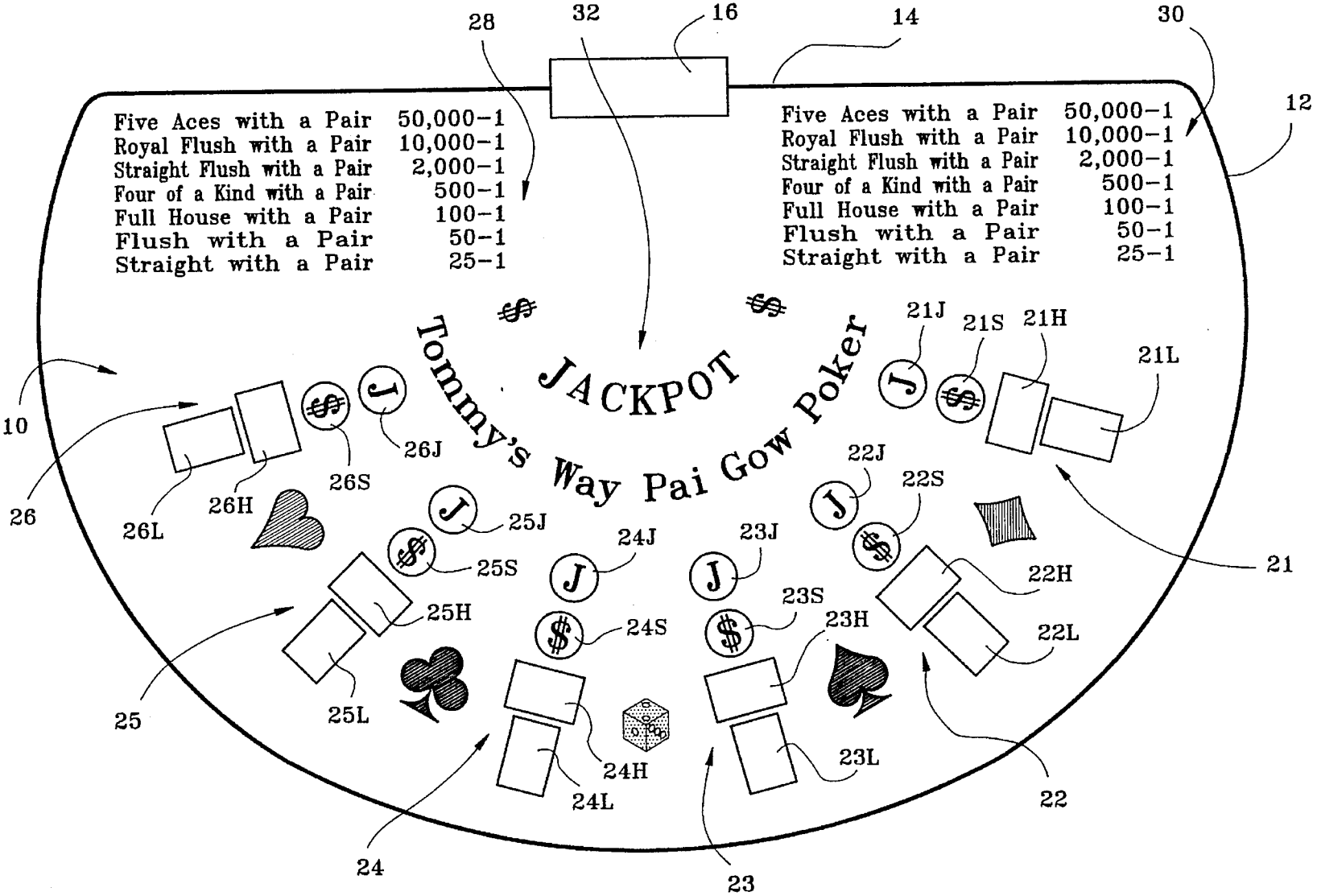
Tommy's Way Pai Gow Poker
JACKPOT
Five Aces with a Pair 50,000-1
Royal Flush with a Pair 10,000-1
Straight Flush with a Pair 2,000-1
Four of a Kind with a Pair 500-1
Full House with a Pair 100-1
Flush with a Pair 50-1
Straight with a Pair 25-1
Five Aces with a Pair 50,000-1
Royal Flush with a Pair 10,000-1
Straight Flush with a Pair 2,000-1
Four of a Kind with a Pair 500-1
Full House with a Pair 100-1
Flush with a Pair 50-1
Straight with a Pair 25-1
10
12
14
16
21
21H
21L
21J
21S
22
22H
22L
22J
22S
23
23H
23L
23J
23S
24
24H
24L
24J
24S
25
25H
25L
25J
25S
26
26H
26L
26J
26S
28
30
32

JACKPOT PAI GOW POKER

FIELD OF THE INVENTION

The present invention is in the general field of games of chance and, more particularly, is an improvement in the game of Pai Gow Poker.

BACKGROUND OF THE INVENTION

The game of Pai Gow Poker, sometimes called Asian Poker, is a relatively new type of poker game that has gained acceptance by casinos at almost all major gambling centers. The game is played with a single standard deck of 52 playing cards plus a Joker.

The game is typically started by each player placing an ante or bet and then a dealer dealing seven cards to himself and each of six players. Usually, the dealer is a casino employee. As explained hereinafter, the players compete against the casino via the dealer.

A player forms two hands from his seven-card holding. One hand, called a Low Hand, consists of two of the seven player's cards. The other hand, called a High Hand, consists of the remaining five cards of the player's hand. In a similar manner, the dealer forms a High Hand and a Low Hand from his seven cards.

The only requirement in forming the hands is that the Low Hand must be of a lower rank than the High Hand. The ranking of a hand is the same as in traditional poker with the exception that the joker can be used to represent an Ace or to represent one card of either a straight or a flush. Because of the joker, five aces is the hand with the highest possible rank.

When the player forms his Low Hand and his High Hand so that they are respectively higher in rank than the Low Hand and the High Hand of the dealer, the player is a winner and the dealer is a loser. Conversely, when the player forms his Low Hand and his High Hand so that they are respectively lower in rank than a Low Hand and a High Hand of the dealer, the player is a loser and the dealer is a winner. In cases where one of the player's hands is of the same rank as a corresponding one of the dealer's hands, the dealer's hand is deemed to be of higher rank than the player's hand.

When the player's Low Hand is of a higher rank than the dealer's Low Hand and the player's High Hand is of lower rank than the dealer's High Hand, what is known as a push exists. Similarly, the push exists when the player's Low Hand is of a lower rank than the dealer's Low Hand and the player's High Hand is of higher rank than the dealer's High Hand. When the push exists, there is no winner.

A determination of a winner correspondingly determines the outcome of the bet between the player and the dealer. Hence, the wager is neither won nor lost when the push exists. Approximately forty percent of the outcomes in Pai Gow Poker are pushes. The occurrence of a push diminishes the excitement of Pai Gow Poker. Since approximately forty percent of the outcomes in Pai Gow Poker are pushes, Pai Gow Poker might be made more exciting by adding an aspect of competition that is dependent solely upon the player's Low or High Hands.

SUMMARY OF THE INVENTION

An object of the present invention is to add an aspect of competition to the game of Pai Gow Poker that is dependent solely upon a player's cards or holding.

According to a first aspect of the present invention, a game of Pai Gow Poker is played on a table top that carries an indicia that indicates where a player places a wagering token representative of a jackpot wager.

According to a second aspect of the present invention, a player in a game of Pai Gow Poker is permitted to make a jackpot wager that the player wins by being dealt a predetermined jackpot hand.

The present invention can be used to provide an opportunity for a player in the game of Pai Gow Poker to win a substantial jackpot payout with only a small increase in the player's risk of loss.

Further objects, features, and advantages of the present invention over the prior art will become apparent from the detailed description of the drawings which follows, when considered with the attached figures.

DESCRIPTION OF THE DRAWINGS

The sole FIGURE herein is a plan view of a table top in accordance with one aspect of the present invention.

DETAILED DESCRIPTION OF THE PREFERRED EMBODIMENT

The subject matter of the present invention is a game called Jackpot Pai Gow Poker which is contemplated for play in a casino environment. As shown in the drawing, the game is played upon a semicircular table top 10 having an arcuate edge 12 and a straight edge 14.

A check rack 16 is mounted upon the table top 10 near the edge 14 substantially midway between ends 18 of the edge 14. The casino's wagering tokens, known as chips, are stored in the check rack 16. A dealer (not shown) is positioned near the check rack 16.

The table top 10 includes a green felt covering that carries six similar, evenly spaced, groups of player station indicia 21–26 near the edge 12. Adjacent to the table top 10, near the groups of indicia 21–26, are six player stations that are designated one through six, respectively. Each player is positioned at or near a player station.

The group 21 includes a circular jackpot indicia 21J with the letter, J, carried therein. A player at station one, who desires to make a jackpot wager, places chips or other betting medium representative of the jackpot wager upon the indicia 21J. It should be understood that the jackpot wager is made before cards are dealt.

In this embodiment, a player wins the jackpot wager by having any one of seven pre-determined jackpot card holdings or combinations. The jackpot card holdings and their corresponding payout rates by the dealer or house/casino are preferably in accordance with the following jackpot table:

| Jackpot Card Holding | Payout Rate |
|---|---|
| Five Aces with a Pair | 50,000–1 |
| Royal Flush with a Pair | 10,000–1 |
| Straight Flush with a Pair | 2,000–1 |
| Four of a Kind with a Pair | 500–1 |
| Full House with a Pair | 100–1 |
| Flush with a Pair | 50–1 |
| Straight with a Pair | 25–1 |

Lettering or other indicia indicating the tabulation portion of the jackpot table is carried at a first location 28 on the table top 10 between the edge 14 and the group 26. The lettering of the tabulation portion is additionally carried at a second location 30 on the table top 10 between the edge 14 and the group 21. The letterings at the locations 28, 30 provides a handy reference for the players, so that they may determine, without memorizing, the card holdings for which a jackpot is paid.

As an example of an application of the jackpot table, when a player places a jackpot wager or bet in the amount of five dollars upon the indicia 21J and is dealt four Aces, the Joker and a pair, that player's seven-card holding is ranked as five aces and a pair. In accordance with the jackpot table, the dealer must make a jackpot payout at a rate of 50,000 to 1. In other words, the dealer must make a jackpot payout of $250,000 to the player.

A statistical evaluation discloses that utilizing the above-stated payout rates, all but 7.05% of jackpot wagers are expected to be returned to the players in the form of jackpot payouts. Therefore, the jackpot wager provides an opportunity for increased participation by the players in a Pai Gow Poker game with only a small increase in the players' risk of loss.

The group 21 additionally includes a circular wagering indicia 21S wherein a dollar sign is carried. A player makes a standard Pai Gow Poker wager by placing chips representative of the standard Pai Gow Poker wager within the indicia 21S. It is understood that in the preferred form of the invention, a player can not participate in the game, including the jackpot aspect, unless he places the standard wager or first bet.

In accordance with the prior art, the player wins the standard wager by arranging his cards into a High Hand and a Low Hand that are respectively higher than the High Hand and the Low Hand of the dealer, as is standard to the game of Pai Gow Poker.

Preferably, when the player's High Hand and Low Hand are formed, they are placed upon rectangular indicia 21H, 21L, respectively, of the group 21. The indicia 21J, 21S, 21H, 21L are radially disposed with the indicia 21J, 21S furthest from the edge 12.

The groups 22–26 respectively include indicia 22J–26J, 22S–26S, 22H–26H, 22L–26L that are respectively similar to the indicia 21J, 21S, 21H, 21L. Moreover, jackpot wagers and standard wagers are won and lost by the players these stations in the same manner as that described above.

In this embodiment, lettering of the words, JACKPOT Pai Gow Poker, are carried on a central location 32 of the table top 10. The lettering informs casino patrons of the game being played on table top 10.

Many variations of the above-stated game are contemplated as within the scope of the invention.

The standard wager or bet which each player must place to participate in the game may comprise chips, coin, tokens, paper money, or the like. The casino or players may pre-set the standard wager or bet to a pre-determined minimum amount which must be wagered to participate in the game. Alternatively, the players and/or casino may elect to have a pre-set limit over which the standard wager may not pass.

The jackpot bet which may be wagered by each player may also have a pre-set minimum or maximum. For example, the casino may require that the player wager $1 in order to participate in the jackpot aspect of the present game.

The layout described above, while preferred, may be varied as desired. In fact, it is not even necessary to utilize a layout when playing the game of the present invention.

The particular predetermined winning jackpot hands may vary from those described above. Further, payout odds for a particular winning jackpot hand, including those listed above, may vary.

It should be understood that the above described arrangements of apparatus and the method therefrom are merely illustrative of applications of the principles of this invention and many other embodiments and modifications may be made without departing from the spirit and scope of the invention as defined in the claims.

I claim:

1. A method of playing a game of chance comprising:

(a) a player placing a first wager;

(b) a player placing a jackpot bet;

(c) a dealer dealing seven cards to himself and said player;

(d) said player arranging said cards into a low hand including two of said seven cards and a high hand including five of said seven cards;

(e) said player evaluating said cards and determining whether said cards comprise a predetermined jackpot card holding of a low hand pair and a high hand of one of (i) four aces and the joker, (ii) a royal flush, (iii) a straight flush, (iv) four of a kind, (v) full house, (vi) flush or (vii) straight;

(f) paying said player a jackpot amount if said player has a jackpot holding;

(f) determining the winner of said first wager by comparing a low hand of said dealer to said low hand of said player and a high hand of said dealer to said high hand of said player.

2. The method of claim 1, wherein said player is paid a jackpot amount in ratio to his jackpot bet for each of the jackpot card holdings in the amounts of: five Aces with a pair, 50,000–1; royal flush with a pair, 10,000–1; straight flush with a pair, 2,000–1; four of a kind with a pair, 500–1; full house with a pair, 100–1; flush with a pair, 50–1; and straight with a pair, 25–1.

3. In the method of playing Pal Gow Poker wherein a player is dealt seven cards from a standard deck of fifty-two cards plus a joker, the improvement comprising:

permitting the player to make a jackpot wager prior to being dealt said seven cards;

dealing said seven cards to the player, said player arranging the seven cards into a two card low hand and a five card high hand; and making a corresponding payout of a jackpot to the player when said jackpot wager is made and said low hand is a pair and the high hand is one of (i) four aces with the joker, (ii) a royal flush, (iii) a straight, (iv) four of a kind, (v) a full house, (vi) a flush or (vii) a straight.

4. The method of claim 3 wherein the jackpot corresponding to the jackpot hands are approximately as follows:

| | |
|---|---|
| (i) five aces with a pair | 50,000/1 |
| (ii) royal flush with a pair | 10,000/1 |
| (iii) straight flush with a pair | 2,000/1 |
| (iv) four of a kind with a pair | 500/1 |
| (v) full house with a pair | 100/1 |
| (vi) flush with a pair | 50/1 |
| (vii) straight with a pair | 25/1. |

* * * * *

UNITED STATES PATENT AND TRADEMARK OFFICE

CERTIFICATE OF CORRECTION

PATENT NO. : 5,584,486

DATED : December 17, 1996

INVENTOR(S) : Thomas L. Franklin

It is certified that error appears in the above-indentified patent and that said Letters Patent is hereby corrected as shown below:

At Column 4, line 52, insert the word "flush" after (iii) a straight

Signed and Sealed this

Eighth Day of July, 1997

Bruce Lehman

*Attest:*

BRUCE LEHMAN

*Attesting Officer*

*Commissioner of Patents and Trademarks*